United States Patent [19]

Burns

[11] 4,290,661

[45] Sep. 22, 1981

[54] PROGRAMMABLE ELECTRICAL CONNECTOR

[75] Inventor: Edgar Burns, Los Angeles, Calif.

[73] Assignee: International Telephone and Telegraph Corporation, New York, N.Y.

[21] Appl. No.: 111,329

[22] Filed: Jan. 11, 1980

[51] Int. Cl.[3] ..... H01R 25/00

[52] U.S. Cl. ..... 339/18 R; 339/75 M

[58] Field of Search ..... 339/18R, 18 B, 75 R, 339/75 M

[56] References Cited

U.S. PATENT DOCUMENTS

| | | | |
|---|---|---|---|
| 2,769,873 | 11/1956 | Moregaard | 339/18 R |
| 2,903,529 | 9/1959 | Hanthorn | 339/18 R |
| 3,315,212 | 4/1967 | Peterson | 339/75 M |
| 3,763,459 | 10/1973 | Millis | 339/75 M |

*Primary Examiner*—Joseph H. McGlynn

*Attorney, Agent, or Firm*—Thomas L. Peterson

[57] ABSTRACT

A zero insertion force electrical connector in which, when the plug and receptacle connector members are initially mated, the contacts therein are spaced from each other. An actuating plate is shifted to move the movable contacts in the plug connector member in tandem in a direction to engage the fixed contacts in the receptacle connector member. A program plate is mounted on the plug connector member having apertures therein through which the movable contacts extend. The apertures in the program plate are dimensioned to allow some of the contact pairs to engage when the actuating plate is shifted, but prevent engagement between other contact pairs. Conductive traces may be provided on the program plate to provide electrical connection between two movable contacts, or between a movable contact of one pair of contacts and a fixed contact of another pair. Other program plates are disclosed allowing different electricl paths through the connector.

15 Claims, 17 Drawing Figures

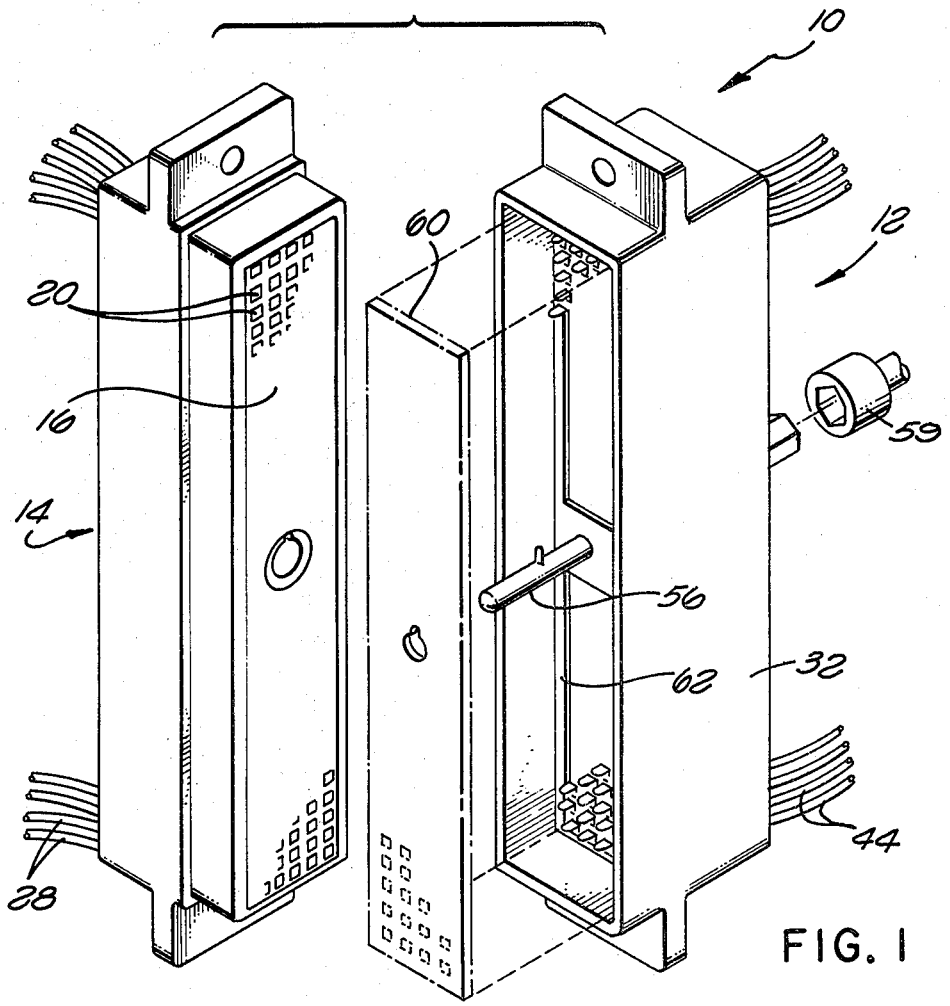
FIG. 1
FIG. 2
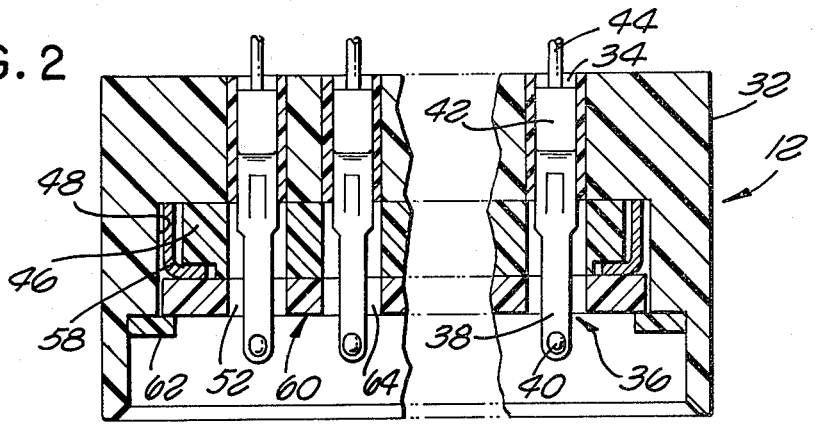

PROGRAMMABLE ELECTRICAL CONNECTOR

BACKGROUND OF THE INVENTION

The present invention relates generally to an electrical connector and, more particularly, to a zero insertion force electrical connector.

The present invention comprises an improvement upon the zero insertion force connector disclosed in U.S. Pat. No. 3,594,698 to Anhalt, assigned to the assignee of the present application. Such connector contains fixed contacts in one connector member and movable contacts in the mating connector member. A split insulator member is provided in the second connector member forming a pair of actuating plates for the movable contacts. A cam shaft is rotatably mounted between the actuating plates in the second connector member. Rotation of the shaft causes the actuating plates to be shifted in opposite directions thereby moving the movable contacts in tandem into electrical engagement with fixed contacts in the first connector member.

Occasionally, there is a need to engage only selected ones of the contact pairs in the aforementioned zero insertion force connector, or to provide electrical paths through the connector different from that afforded by engagement of the mating fixed and movable contacts in the connector. For example, modification of electrical paths through the connector may be required for testing, experimentation, equipment repairs, or for countless other purposes. Thus, what is desired and constitutes the object of the present invention is to provide means for selectively altering or controlling the electrical paths through a zero insertion force electrical connector.

SUMMARY OF THE INVENTION

According to a principal aspect of the present invention, there is provided a zero insertion force electrical connector of the type described hereinabove wherein a program plate is mounted between the plug and receptacle connector members of the connector. The program plate embodies a plurality of apertures therein through which the movable contacts of the connector extend. The program plate embodies means for controlling the electrical paths through the associated contacts in the two halves of the electrical connector. As will be appreciated from the following description, the program plate may be constructed in any desired form to meet the special requirements of any particular application. Different program plates may be selectively mounted in the connector to provide the desired electrical paths through the connector for different applications.

BRIEF DESCRIPTION OF THE DRAWINGS

FIG. 1 is an exploded perspective view of the connector of the present invention prior to mating of the plug connector member with the receptacle connector member, with a program plate shown in phantom which is removably mounted in the plug connector member;

FIG. 2 is a transverse sectional view through the plug connector member illustrated in FIG. 1 showing how the program plate is mounted over the actuating plate in the connector member;

DESCRIPTION OF THE PREFERRED EMBODIMENTS

Figure 3:
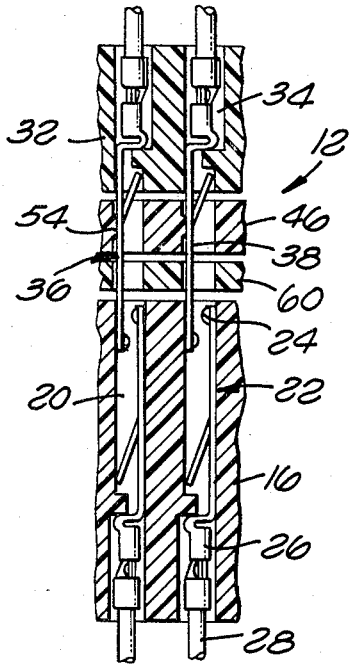
FIG. 3 is a fragmentary longitudinal sectional view through the connector of the present invention with the plug and receptacle connector members fully mated, but prior to actuation of the movable contacts in the plug and connector member.

Referring now to the drawings in detail, there is illustrated in FIGS. 1–5 one embodiment of the zero insertion force electrical connector of the present invention, generally designated 10. The connector comprises a plug connector member 12 and a mating receptacle connector member 14. The receptacle connector member 14 comprises an insulator 16 formed with a plurality of openings 20 which extend lengthwise between the front and rear faces of the insulator. Each opening contains an individual fixed contact 22 which is formed with a contacting surface 24 that is disposed within the opening 20. Each contact terminates in a terminal portion 26 which is connected to a wire 28.

Figure 4:
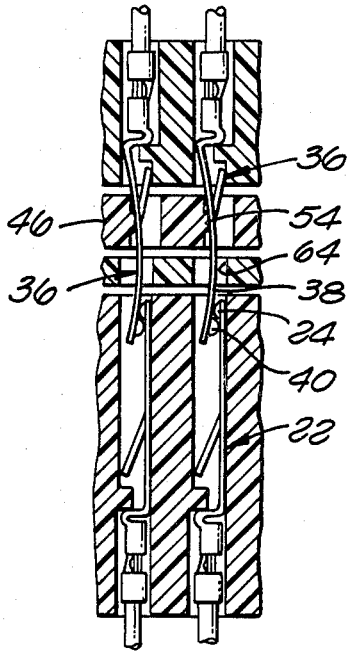
FIG. 4 is a fragmentary longitudinal sectional view similar to FIG. 3 showing the contacts in their actuated condition.
Figure 5:
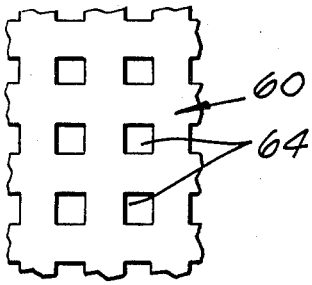
FIG. 5 is a fragmentary elevational view of the program plate mounted in the connector illustrated in FIGS. 1–4 which allows normal actuation of the contacts in the connector.

The plug connector member 12 comprises an insulator 32 formed with a plurality of openings 34 which extend lengthwise through and are aligned with the openings 20 in the receptacle connector member 14 when the plug and receptacle connector members are mated. A movable contact 36 is mounted in each of the openings 34. Each contact 36 includes an elongated beam portion 38 which extends outwardly from the opening 34 and terminates in a contacting surface 40. Each contact 36 has a rear wire termination portion 42 connected to a wire 44. A pair of actuating plates 46 are slidably mounted in a recess 48 in the insulator 32, only one of such plates being illustrated in FIG. 2. The plate is formed with a plurality of spaced apertures 52 through which the contacts 36 extend. As seen in FIG. 4, a projection 54 is formed on the wall of each aperture 52 engaging the beam portion 38 of each contact 36.

As seen in FIG. 1, an actuating shaft 56 is mounted in the plug connector member 12. The shaft extends through the center of the insulator 32 between the actuating plates 46. The shaft is rotatable about a horizontally extending axis which is parallel to the contacts 36 and thus perpendicular to the face of the fixed insulator 32. As seen in FIG. 2, a retaining bracket 58 is fixedly mounted in the insulator 32 in front of the actuating plates 46 retaining the plates within the connector. The actuating shaft may be rotated by a suitable tool, such as shown at 59 in FIG. 1. The shaft embodies cam surfaces, not shown, which urge the actuating plates 46 in opposite directions upon rotation of the shaft to actuate the movable contacts 36.

Reference is made to the aforementioned Anhalt patent for a more detailed description of the structure of the actuating shaft and how it cooperates with the plates 46 to actuate the movable contacts of the connector. For the purposes of this description, it is only necessary to understand that when the plug and receptacle connector members are initially mated, the contacting surfaces 24 and 40 of the contacts 22 and 36, respectively, are spaced apart, as seen in FIG. 3, thereby permitting mating of the connector halves with zero insertion force. When the actuating shaft 56 is rotated in one direction, after mating of the connector halves, the actuating plates 46 are shifted in directions opposite to each other, that is, in the vertical direction as the connector is illustrated in FIG. 1, and in the horizontal rightward direction as the connector is illustrated in FIGS. 3 and 4, whereupon the projections 54 on the actuating plates shift the contacting surfaces 40 of movable contacts 36 toward engagement with the contacting surfaces 24 on the fixed contacts 22 in the receptacle connector member. Thus, rotation of the actuating shaft shifts all the movable contacts in tandem in a direction toward engagement with the fixed contacts in the receptacle connector member. Rotation of the cam shaft in the opposite direction causes the actuating plates 46 to return to their normal de-activated position under the resilient force of the spring beams 38 of the contacts 36. If desired springs, not shown, may be mounted in the fixed insulator 32 urging the actuating plates 46 to their inactive position.

According to the present invention, a program plate 60 is mounted between the plug and receptacle connector member to allow selective control of the electrical paths through the associated contacts in the connector members. While the plate 60 could be mounted in the receptacle connector member, preferably the plate is mounted in the plug connector member in front of the actuating plates 46. Preferably, the program plate is removably mounted in the insulator 32 by a suitable removable retaining bracket 62 which may be secured to the insulator by readily releasable fastening or latching means, not shown. The program plate 60 has apertures 64 therein which are aligned with the contact openings 34 in the insulator 32 so that the movable contacts 36 extend through the apertures.

In the embodiment of the invention illustrated in FIGS. 1-5, the program plate 60 is "non-operational" inasmuch as the apertures 64 therein have a uniform configuration, matching that of the contact receiving apertures 52 in the actuating plates 46, so that when the actuating plates are shifted by rotation of the shaft 56, the movable contacts 36 are all allowed to be moved in tandem into engagement with the fixed contacts as seen in FIG. 4. Thus, the program plate 60 in the embodiment illustrated in FIGS. 1-5 controls the electrical paths through the connector 10 to the extent that it does not alter the normal or predetermined paths through the associated pairs of movable and fixed contacts 36 and 22, respectively.

Figure 6:
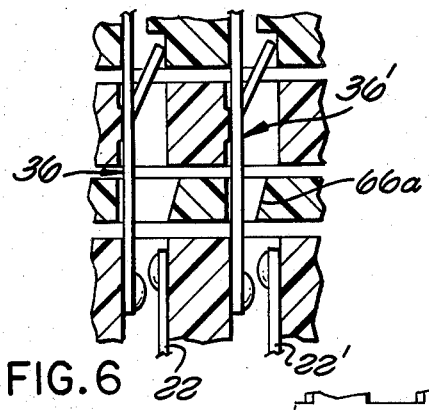
FIG. 6 is a fragmentary longitudinal sectional view through the connector of the present invention incorporating the program plate illustrated in FIG. 8, with the plug and receptacle connector members being shown fully mated, but prior to actuation of the contacts.
Figure 7:
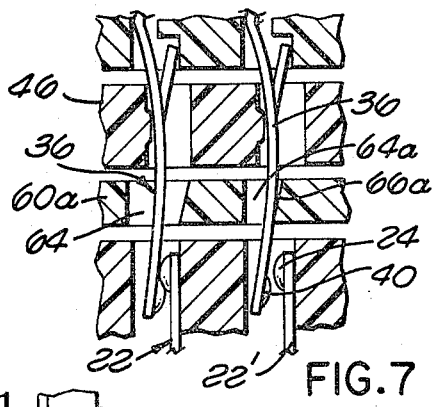
FIG. 7 is a fragmentary longitudinal sectional view similar to FIG. 6 showing the movable contacts shifted toward their actuated position.
Figure 8:
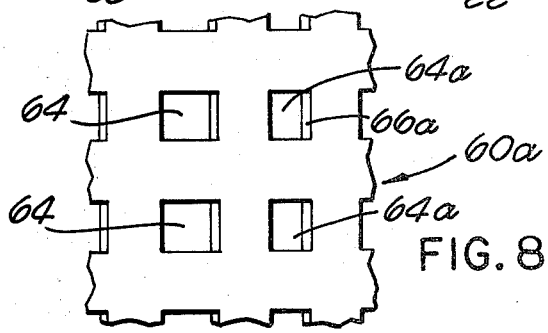
FIG. 8 is a fragmentary elevational view of the program plate employed in the connector illustrated in FIGS. 6 and 7.

In the embodiment of the invention illustrated in FIGS. 6-8, the program plate 60*a* contains apertures 64*a* of a size smaller than the apertures 64. That is, the apertures 64*a* are shorter in the direction of movement of the actuating plate 46, that is, in the horizontal direction as viewed in FIGS. 6-8. The apertures 64*a* are sufficiently short so that when the actuating plate 64 is shifted in the rightward direction to its actuated position, as seen in FIG. 7, the edge 66*a* of each aperture 64*a* will block and thereby prevent the contact 36' from engaging the contact 22', while the contacts 36 and 22 are still permitted to engage. Thus, in this embodiment of the invention, for any contact pair which is desired not to have engagement when the actuating plates are activated, the apertures in the program plate receiving the movable contact of such contact pair is made shorter than the other apertures.

Figure 9:
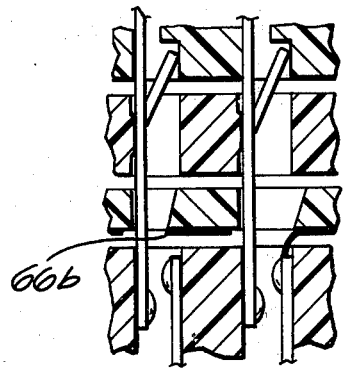
FIG. 9 is a fragmentary longitudinal sectional view through the connector of the present invention incorporating the program plate illustrated in FIG. 11, with the plug and receptacle connector members being shown fully mated, but prior to actuation of the contacts.
Figure 10:
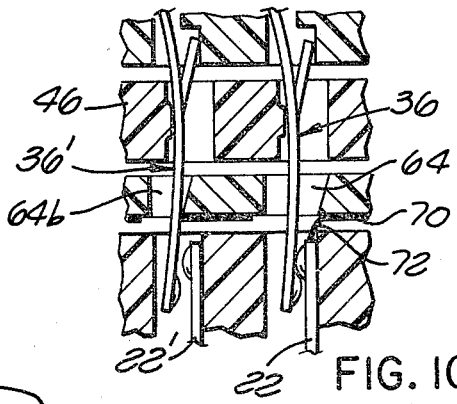
FIG. 10 is a fragmentary longitudinal sectional view similar to FIG. 9 showing the movable contacts shifted toward their actuated position.
Figure 11:
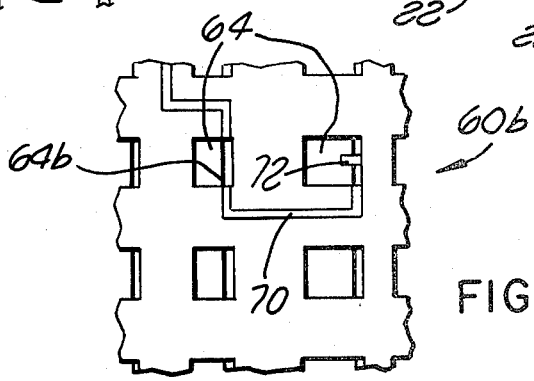
FIG. 11 is a fragmentary elevational view of the program plate employed in the connector illustrated in FIGS. 9 and 10.

Reference is now made to FIGS. 9-11 which show a further embodiment of the invention wherein the program plate 60*b* contains apertures 64 and 64*b* of different lengths, similar to the plate 60*a*, thereby allowing engagement between the contacts 22 and 36, but blocking engagement between the contacts 22' and 36'. In this embodiment, a thick conductive layer 70, such as copper, is provided on the front face of the program plate 60*b*. One portion of the conductive layer extends to the edge 66*b* of the aperture 64*b* while a second portion of the layer adjacent to the aperture 64 is formed with a forwardly extending contact tab 72 which is positioned to engage the fixed contact 22 in the receptacle connector member when the connector halves are mated. Thus, when the actuating plate 46 is activated, as seen in FIG. 10, the contact 36' is prevented from engaging contact 22', but instead engages the conductive layer 70 at the edge 66*b* of the aperture 64*b*, the contacts 36 and 22 engage, the electrical connection is made between the movable contact 36' and the two contacts 22 and 36 via the conductive layer 70. Thus, in the embodiment illustrated in FIGS. 9-11, the program plate allows disconnection between a movable contact and its natural mating fixed contact and connects it instead to another set of mating contacts.

Figure 12:
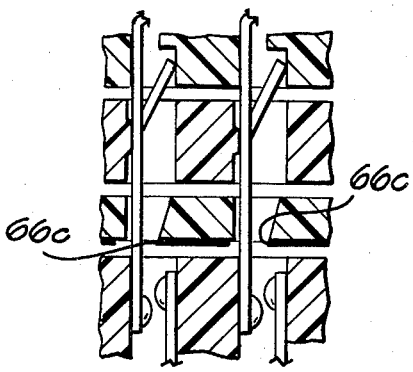
FIG. 12 is a fragmentary longitudinal sectional view through the connector of the present invention incorporating the program plate illustrated in FIG. 14, with the plug and receptacle connector members being shown fully mated, but prior to actuation of the contacts.
Figure 13:
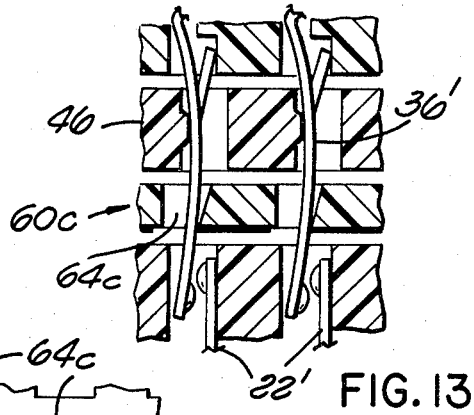
FIG. 13 is a fragmentary longitudinal sectional view similar to FIG. 12 showing the movable contacts shifted toward their actuated position.
Figure 14:
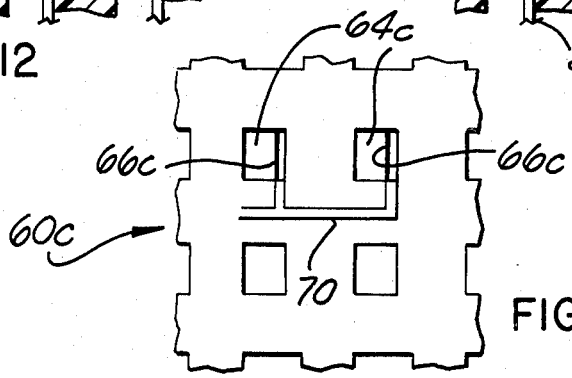
FIG. 14 is a fragmentary elevational view of the program plate employed in the connector illustrated in FIGS. 12 and 13.

FIGS. 12–14 illustrate an additional embodiment of the invention wherein the program plate 60*c* contains relatively long apertures 64 and a pair of relatively short apertures 64*c* the edges 66*c* of which are joined by a conductive layer 70. The two movable contacts 36' extending through the apertures 64*c* are prevented from engaging the fixed contacts 22' when the actuating plate 46 is shifted to its activated position, but the conductive layer 70 on the program plate electrically interconnects the movable contacts. The movable contacts, not shown, which extend through the apertures 64 are allowed to engage their mating fixed contacts upon actuation of the plate 46 in the manner described hereinbefore. Thus, the program plate 60*c* connects two movable contacts on the plug connector member, while disconnecting the mating fixed contacts in the receptacle connector member.

Figure 15:
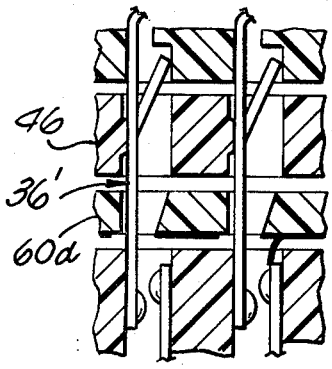
FIG. 15 is a fragmentary longitudinal sectional view through the connector of the present invention incorporating the program plate illustrated in FIG. 17, with the plug and receptacle connector members being shown fully mated, but prior to actuation of the contacts.
Figure 16:
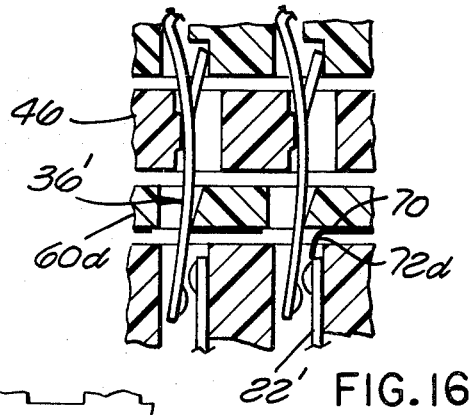
FIG. 16 is a fragmentary longitudinal sectional view similar to FIG. 15 showing the movable contacts shifted toward their actuated position.
Figure 17:
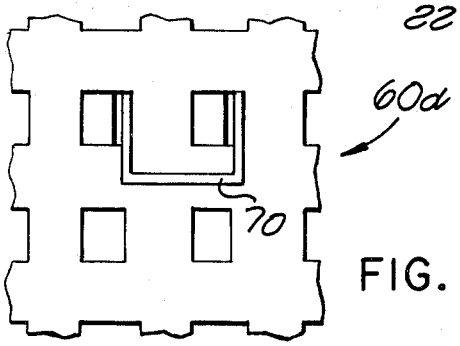
FIG. 17 is a fragmentary elevational view of the program plate employed in the connector illustrated in FIGS. 15 and 16.

FIGS. 15–17 show a further embodiment of the invention wherein the program plate 60*d* is similar to the plate 60*c* except that the end 72*d* of the trace 70 is in the form of a contact tab extending forwardly to a position to engage one of the fixed contacts 22'. Thus, when the actuating plate 46 is shifted to its activated position, the program plate prevents engagement between each movable contact 36' and its natural mating fixed contact 22' but provides electrical connection between the left movable contact 36' and the right fixed contact 22', as viewed in FIG. 16, via the conductive layer 70 and tab 72*d*. Thus, this arrangement disconnects a movable contact's natural mating with a fixed contact and connects it instead to another fixed contact in the receptacle connector member.

It will be appreciated that any combination of the above-described arrangements may be provided in the program plate of the present invention. The program plates may be stamped or molded insulator plates. The plates may be formed with small barriers in the apertures selected ones of which may be removed with the use of a tool to allow engagement of the mating contacts associated with such selected apertures. It will be further appreciated that different programs may be provided for an electrical connector by simply removing one program plate and replacing it with another.

What is claimed is:

1. An electrical connector comprising:

a first connector member having a first set of movable contacts therein;

a second connector member having a second set of fixed contacts therein, each contact in said second set being associated with one of the contacts in said first set;

the associated contacts of said first and second sets of contacts being positioned laterally adjacent to but spaced from each other when said connector members are initially mated;

means for laterally shifting said first set of contacts in tandem in a direction to engage said second set of contacts, said associated contacts, if engaged, providing predetermined electrical paths through the connector;

a program plate mounted between said first and second connector members having apertures therein through which said movable contacts extend; and said program plate embodying means for controlling the electrical paths through the associated contacts of said first and second sets of contacts upon activation of said contact shifting means.

2. An electrical connector as set forth in claim 1 including:

means removably mounting said program plate on one of said connector members.

3. An electrical connector as set forth in claim 1 including:

means removably mounting said program plate on said first connector member.

4. An electrical connector as set forth in claim 1 wherein:

said controlling means alters the predetermined electrical paths through selected ones of said associated contacts upon activation of said contact shifting means.

5. An electrical connector as set forth in claim 4 wherein:

said controlling means allows engagement between selected ones of said associated contacts but prevents engagement between selected others of said associated contacts upon activation of said contact shifting means.

6. An electrical connector as set forth in claim 5 wherein:

said controlling means comprises apertures in said program plate of different lengths in said direction.

7. An electrical connector as set forth in claim 4 wherein:

said controlling means includes a conductive layer on said program plate extending to the edge of at least one of the apertures therein receiving a movable contact of said selected ones of said associated contacts.

8. An electrical connector as set forth in claim 7 wherein:

said conductive layer extends to the edges of a plurality of the apertures in said program plate receiving movable contacts of said selected ones of said associated contacts.

9. An electrical connector as set forth in claim 4 wherein:

said controlling means includes a conductive layer on said program plate engaging a fixed contact of at least one of said selected ones of said associated contacts.

10. An electrical connector as set forth in claim 9 wherein:

said conductive layer extends to the edge of an apertures in said program plate receiving a movable contact of another one of said selected ones of said associated contacts.

11. An electrical connector comprising:

a first connector member having a first set of movable contacts therein;

a second connector member having a second set of fixed contacts therein, each contact in said second set being associated with one of the contacts in said first set;

the associated contacts of said first and second sets of contacts being positioned laterally adjacent to but spaced from each other when said connector members are initially mated;

means for laterally shifting said first set of contacts in tandem in a path toward engagement with said second set of contacts;

a program plate removably mounted between said first and second connector members having apertures therein through which said movable contacts extend;

said apertures including at least one relatively short aperture and at least one relatively long aperture in the direction of said path; and one edge of said short aperture preventing engagement of the movable contact extending through the aperture with its corresponding fixed contact and said long aperture allowing engagement of the movable contact extending therethrough with its corresponding fixed contact when said contact shifting means is actuated.

12. An electrical connector as set forth in claim 11 including:

a conductive layer on said program plate extending to said edge of said short aperture.

13. An electrical connector as set forth in claim 12 wherein:

said conductive layer engages the fixed contact associated with the movable contact extending through said long aperture.

14. An electrical connector as set forth in claim 12 including:

a second one of said short apertures in said program plate; and said conductive layer extends to one edge of said second short aperture.

15. An electrical connector as set forth in claim 12 including:

a second one of said short apertures in said program plate; and said conductive layer engages the fixed contact associated with the movable contact extending through said second short aperture.

* * * * *